US006298796B1

(12) United States Patent
Okazaki et al.

(10) Patent No.: US 6,298,796 B1
(45) **Date of Patent: *Oct. 9, 2001**

(54) FINE COAL POWDER COMBUSTION METHOD FOR A FINE COAL POWDER COMBUSTION BURNER

(75) Inventors: Hirofumi Okazaki, Hitachinaka; Hironobu Kobayashi, Hitachi; Toshikazu Tsumura, Kure; Kenji Kiyama, Kure; Tadashi Jinbo, Kure; Koji Kuramashi, Kure; Shigeki Morita, Hiroshima; Shinichiro Nomura, Kure; Miki Shimogori, Kure, all of (JP)

(73) Assignees: Hitachi, Ltd.; Babcock-Hitachi Kabushiki Kaisha, both of Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/515,713

(22) Filed: Mar. 1, 2000

(30) Foreign Application Priority Data

Mar. 3, 1999 (JP) ..... 11-055319

(51) Int. Cl.[7] ..... F23B 7/00; F23D 1/00

(52) U.S. Cl. ..... 110/345; 110/342; 110/261; 110/265

(58) Field of Search ..... 110/260, 261, 110/262, 263, 264, 342, 345; 431/181, 8, 10

(56) References Cited

U.S. PATENT DOCUMENTS

| | | | | |
|---|---|---|---|---|
| 3,421,824 | * | 1/1969 | Herbst | 431/10 |
| 4,807,541 | * | 2/1989 | Masai et al. | 110/262 |
| 4,933,163 | * | 6/1990 | Fischer et al. | 423/574 R |
| 5,090,339 | * | 2/1992 | Okiura et al. | 110/263 |
| 5,231,937 | * | 8/1993 | Kobayashi et al. | 110/262 |
| 5,513,583 | * | 5/1996 | Battista | 110/261 |
| 5,588,380 | * | 12/1996 | LaRose | 110/263 |
| 5,680,823 | * | 10/1997 | La Rose | 110/262 |
| 5,685,242 | * | 11/1997 | Narato et al. | 110/262 |
| 5,697,306 | * | 12/1997 | LaRue et al. | 110/261 |
| 5,799,594 | * | 9/1998 | Dernjatin et al. | 110/265 |
| 5,823,764 | * | 10/1998 | Alberti et al. | 431/184 |
| 5,829,369 | * | 11/1998 | Sivy et al. | 110/347 |
| 5,842,426 | * | 12/1998 | Ohta et al. | 110/261 |
| 5,937,770 | * | 8/1999 | Kobayashi et al. | 110/263 |
| 5,979,342 | * | 11/1999 | Leisse et al. | 110/264 |
| 6,053,118 | * | 4/2000 | Okamoto et al. | 110/261 |
| 6,112,676 | * | 9/2000 | Okazaki et al. | 110/261 |
| 6,189,464 | * | 2/2001 | Okazaki et al. | 110/347 |

FOREIGN PATENT DOCUMENTS

| | | |
|---|---|---|
| 1-305206 | 12/1989 | (JP) . |
| 3-110308 | 5/1991 | (JP) . |
| 3-211304 | 9/1991 | (JP) . |

* cited by examiner

*Primary Examiner*—Henry Bennett
*Assistant Examiner*—Kenneth B Rinehart
(74) *Attorney, Agent, or Firm*—Mattingly, Stanger & Malur

(57) ABSTRACT

A burner for burning fine coal powder comprising: a fine coal powder nozzle 10 for injecting a mixture of the fine coal powder and air; and air nozzles 11, 12 for injecting air: wherein the sufficient amount of air for complete combustion of the fine coal powder is supplied from the air nozzles; a reducing flame at a high temperature is formed by consuming oxygen rapidly with forming a flame at a high temperature by igniting the fine coal powder rapidly in the vicinity of the outlet of the burner; and an oxidizing flame having an uniform distribution of gas composition in radial direction to the central axis of the burner is formed by mixing the air injected from the air nozzle in the downstream of the reducing flame at the high temperature.

7 Claims, 8 Drawing Sheets

FINE COAL POWDER COMBUSTION METHOD FOR A FINE COAL POWDER COMBUSTION BURNER

BACKGROUND OF THE INVENTION

The present invention relates to a combustion burner of fine coal powder, wherein the fine coal powder is transported by an air flow, and a combustion apparatus of fine coal powder using same. Particularly, the present invention relates to a combustion burner for burning fine coal powder and a combustion apparatus of fine coal powder, both of which are preferable for decreasing concentration of nitrogen oxide (hereinafter, called as NOx) and unburned component in ashes.

Generally, suppression of NOx, which is generated in combustion, becomes a problem for combustion burners. Particularly, coal has a larger nitrogen content in comparison with gaseous fuels and liquid fuels.

Therefore, decreasing the amount of NOx generated in operation of the fine coal powder combustion burner is more important than the cases of the gaseous fuels and liquid fuels. Most of the NOx generated in burning coal (fine coal powder) is NOx (fuel NOx), which is generated by oxidizing nitrogen components contained in the coal.

Hitherto, various burner structures and combustion methods have been studied for decreasing the NOx. One of the effective combustion methods is a method (two stage combustion method) for burning the coal completely by supplying a deficient amount of air for complete combustion of the fine coal powder from the fine coal powder burner, and then, supplying additional air to make the amount of air sufficient for complete combustion in the downstream of the fine coal powder burner.

One other method is a method utilizing a reducing reaction of NOx, which is activated when oxygen concentration is low, by forming a region having a low oxygen concentration in flame. For instance, JP-A-1-305206 (1989), JP-A-3-211304 (1991), JP-A-3-110308 (1991), and others disclosed a method for burning coal completely by forming flame (reducing flame) having a low oxygen concentration atmosphere, and a structure, wherein a fine coal powder nozzle for transporting fine coal powder by an air flow is set at a center, and air nozzles for injecting air are arranged outside around the fine coal powder nozzle.

In accordance with these low NOx burners, a region having a low oxygen concentration is formed in flame, and NOx is reduced to harmless nitrogen molecules by generating NOx reducing materials such as ammonia and hydrogen cyanide from the nitrogen components contained in the fine coal powder in the reducing flame region. That is, the amount of NOx generated in the flame is decreased, because the NOx is reduced to nitrogen molecules.

In the case of using the two stage combustion method, the amount of air supplied to the fine coal powder burner is smaller than the amount of air necessary for complete combustion of the fine coal powder. Accordingly, air (air for second stage combustion) is further supplied in the downstream of the fine coal powder burner for complete combustion. Therefore, the combustion apparatus for the two stage combustion method must be provided with a space for mixing the air for second stage combustion with the fine coal powder.

For instance, a boiler furnace (combustion apparatus) for 1000 MW power generation requires to ensure approximately five meters in height as a mixing space for second stage combustion air per sixty meters in height of the furnace. In accordance with a single stage combustion method, wherein all the air for combustion is supplied by the fine coal powder burner, the mixing space can be omitted, and the height of the furnace can be decreased. However, in the case of the single stage combustion method, the air for combustion is readily mixed with the fine coal powder flow, and, even if the low NOx burner is used, the releasing amount of NOx tends to increase significantly in comparison with the case of the two stage combustion method. If a strong swirl is given to the combustion air in order to suppress mixing the fine coal powder with the combustion air supplied from the air nozzle, the fine coal powder is not mixed completely with the combustion air even in the downstream region of the burner, and the amount of unburned component in the ashes is increased.

SUMMARY OF THE INVENTION

The present invention is achieved in consideration of the above problems.

One of the objects of the present invention is to provide a combustion apparatus of fine coal powder, and a combustion burner of fine coal powder, whereby the generating amount of NOx and the unburned component in the ashes are decreased without increasing the height of the furnace.

In accordance with the present invention, a fine coal powder combustion burner is provided, which comprises: fine coal powder nozzles, which inject a mixture of air and the fine coal powder; and air nozzles, which inject air: wherein the sufficient amount of air for burning the fine coal powder completely is supplied from the air nozzles; a flame at a high temperature is formed by igniting the fine coal powder rapidly in the vicinity of the outlet of the burner in order to form a reducing flame at a high temperature (flame, wherein a ratio of actual amount of air to a necessary amount of air for burning completely the components released from the fine coal powder as gases is smaller than 1) by consuming oxygen rapidly; and an oxidizing flame (flame, wherein a ratio of actual amount of air to a necessary amount of air for burning completely the components released from the fine coal powder as gases is larger than 1) having an uniform distribution of gas composition in radial direction from the central axis of the burner is formed by mixing the air injected from the air nozzle in the downstream of the reducing flame at the high temperature, in order to achieve the object of the present invention.

Furthermore, in accordance with the present invention, a fine coal powder combustion burner is provided, which comprises: fine coal powder nozzles, which inject a mixture of air and the fine coal powder, and air nozzles, which inject air: wherein the sufficient amount of air for burning the fine coal powder completely is supplied from the air nozzles; flame at a high temperature higher than 1200° C. is formed by igniting the fine coal powder rapidly in the vicinity of the outlet of the burner (within three times of the burner throat diameter from the fine coal powder nozzle outlet in the fine coal powder injecting direction); a reducing flame (flame, wherein a ratio of actual amount of air to a necessary amount of air for burning completely the components released from the fine coal powder as gases is smaller than 1) is formed in the vicinity of the burner; and an oxidizing flame (flame, wherein a ratio of actual amount of air to a necessary amount of air for burning completely the components released from the fine coal powder as gases is larger than 1) having an uniform distribution of gas composition in radial direction from the central axis of the burner is formed by mixing the air injected from the air nozzle in the downstream of the reducing flame at the high temperature, in order to burn the fine coal powder.

In this case, a flame having a length of 1 to 1.5 times of the burner throat diameter is formed in a perpendicular direction (radial direction) to the injecting direction of the fine coal powder in the vicinity of the burner (a position at two times of the burner throat diameter from the tip of the fine coal powder burner in the injecting direction of the fine coal powder), and a flame having a length of at least two times of the burner throat diameter is formed in the radial direction in the downstream of the vicinity of the burner.

A ratio of momentum of fine coal powder flow at the outlet of the fine coal powder nozzle in the injecting direction (axial direction) to momentum of the air flow at the outlet of the air nozzle is set as 1:5–7 by supplying sufficient amount of air for perfect combustion of the fine coal powder from the burner and making the injecting velocity of the fine coal powder flow injected from the fine coal powder nozzle at least 20 m/s.

Furthermore, the tip of the air nozzle is formed in a reversely tapered shape, and the air injected from the air nozzles positioned at outermost periphery of the burner is injected with an angle in the range of 35–55 degrees to the fine coal powder injecting direction (axial direction).

In accordance with the present invention, a fine coal powder combustion burner comprising fine coal powder nozzles for injecting a mixture of the fine coal powder and primary air; secondary air nozzles for injecting secondary air, which are arranged at outer periphery of the fine coal powder nozzles concentrically with the fine coal powder nozzles; tertiary air nozzles for injecting tertiary air, which are arranged at outer periphery of the secondary air nozzles concentrically with the secondary air nozzles; and a reversely tapered portion, which is arranged at the tip of the outer peripheral wall of the secondary air nozzle; which further comprises a flow changing means for making the secondary air injected from the secondary air nozzles flow at outer peripheral side so that the secondary air flows along the reversely tapered portion of the secondary air nozzles, wherein a ratio of momentum of fine coal powder flow at the outlet of the fine coal powder nozzle in the injecting direction (axial direction) to momentum of the air flow at the outlet of the tertiary air nozzle is set as 1 to 5–7 by supplying sufficient amount of air for perfect combustion of the fine coal powder from the burner.

In this case, the flow changing means is arranged at tip of the inner peripheral wall of the secondary air nozzles, and formed with guide vanes, which are provided with a more acute angle than the reversely tapered portion provided at the tip of the outer peripheral wall of the secondary air nozzles. In accordance with the present invention, the fine coal powder combustion burner is used in the fine coal powder combustion apparatus.

That is, in accordance with the fine coal powder combustion apparatus, or the fine coal powder combustion method formed as the above composition, the air flow from the air nozzles are injected in a direction toward an outer peripheral direction to the central axis of the fine coal powder nozzles; the air flows separately far from the center of the flame in the front stage of the flame; the air flows toward the center of the flame in the rear stage of the flame (a distance at least three times of the burner throat diameter from the outlet of the burner nozzle); and a reducing flame having a low oxygen concentration is formed in the central portion of the fine coal powder combustion flame by consuming the oxygen by a combustion reaction in the downstream of the combustion region.

Furthermore, in the rear stage of the flame, the air injected from the air nozzles is mixed with the fine coal powder flown in the central portion of the flame, and an oxidizing flame is extended in the radial direction.

Because of passing most of the fine coal powder through the reducing flame, the exhausted NOx concentration is decreased, distribution of the air becomes uniform, and any region, wherein the gaseous phase has an extremely low air ratio, is not formed.

Accordingly, the combustion reaction is proceeded, the combustion efficiency is improved, and decrease of the unburned component in the ashes is realized.

BRIEF DESCRIPTION OF THE DRAWINGS

These and other objects, features and advantages of the present invention will be understood more clearly from the following detailed description with reference to the accompanying drawings, wherein.

DETAILED DESCRIPTION OF THE PREFERRED EMBODIMENTS (Embodiment 1)

Hereinafter, the first embodiment of the present invention is explained referring to FIG. 1 to FIG. 4.

Figure 1:
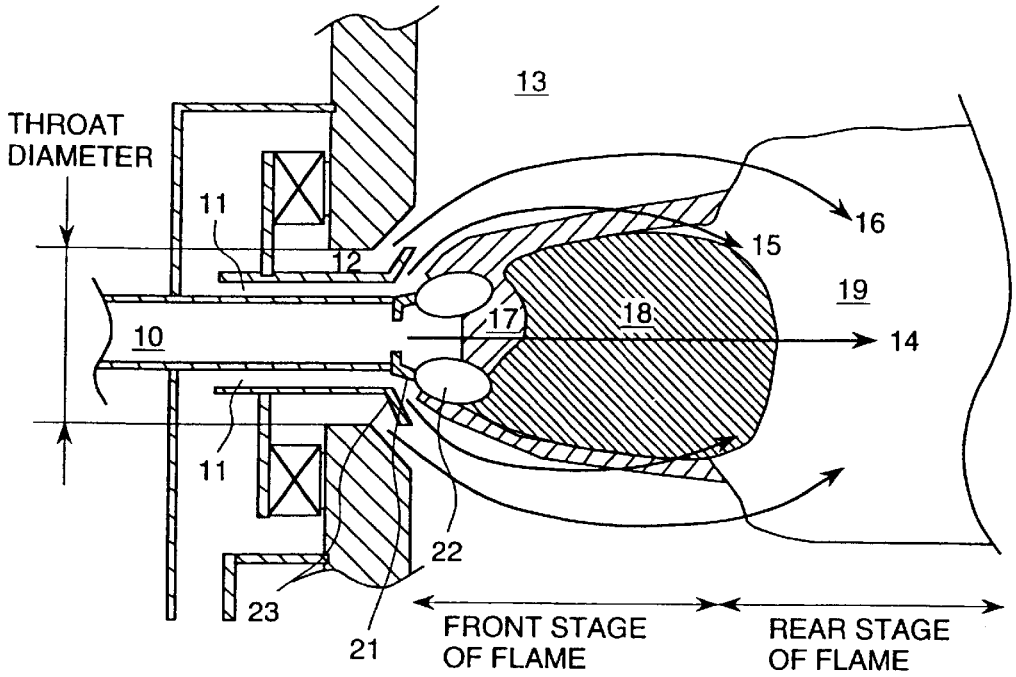
FIG. 1 is a vertical cross sectional view indicating a first embodiment of the fine coal powder burner of the present invention.
Figure 2:
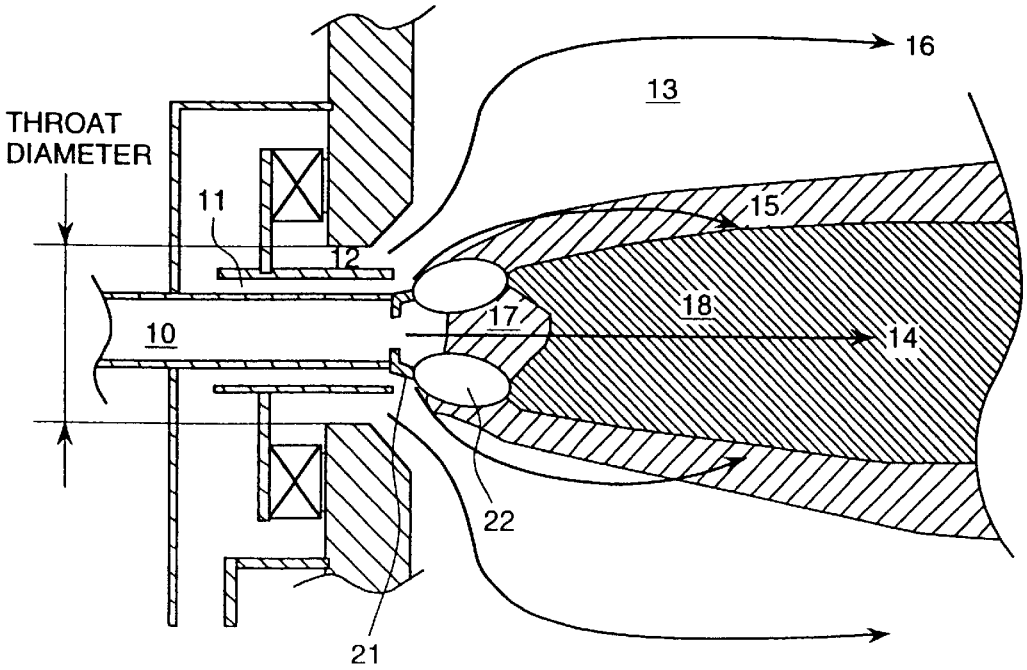
FIG. 2 PRIOR ART
FIG. 2 is a vertical cross sectional view of a fine coal powder burner relating to the prior art indicating for comparison with the first embodiment of the present invention.
Figure 3:
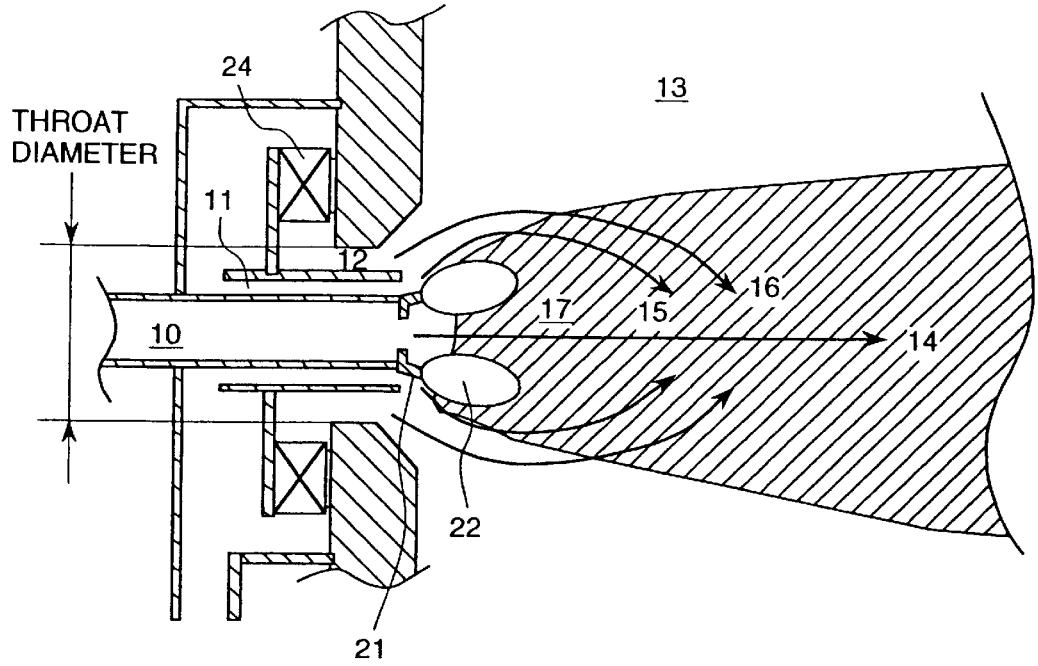
FIG. 3 PRIOR ART
FIG. 3 is a vertical cross sectional view of a fine coal powder burner relating to the prior art indicating for comparison with the first embodiment of the present invention.
Figure 4:
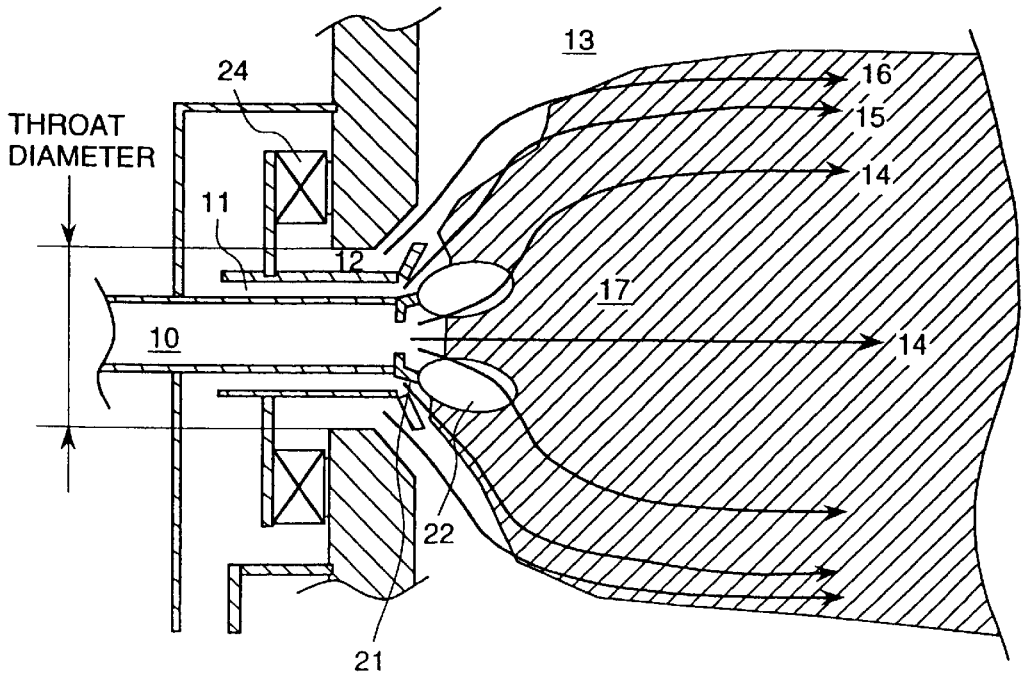
FIG. 4 PRIOR ART
FIG. 4 is a vertical cross sectional view of a fine coal powder burner relating to the prior art indicating for comparison with the first embodiment of the present invention.

FIG. 1 is a schematic illustration of the fine coal powder combustion burner of the present invention, and FIG. 2 to FIG. 4 are schematic illustrations of the burners of the prior art indicated in order to compare with the fine coal powder combustion burner indicated in FIG. 1. Table 1 indicates concentrations of NOx and unburned component in the ashes at the outlet of the combustion apparatus in the fine coal powder burners indicated in FIG. 1 to FIG. 4.

In accordance with the fine coal powder burners indicated in FIG. 1 to FIG. 4, the mark 10 indicates a fine coal powder nozzle for air flow transportation of the fine coal powder, and a transportation pipe (not shown in the figures) is connected to the nozzle in the upstream of the nozzle. Two air nozzles for injecting air for combustion are arranged concentrically. Respective of the marks 11 and 12 indicates secondary air nozzle and the third air nozzle, respectively. The mark 13 indicates a space in the furnace for burning the fine coal powder and the air injected from the burner, and the mark 14 indicates a flow of fine coal powder injected from the fine coal powder nozzle. Respective of the marks 15 and 16 indicates the flow of air injected from respective of the secondary air nozzle and the third air nozzle.

In accordance with the present embodiment, a single stage combustion, wherein all the air necessary for complete burning of the fine coal powder is supplied from the fine coal powder burner, is used. In this case, the amount of air actually supplied from the fine coal powder burner is approximately 1.1–1.25 times of the theoretically necessary amount of the air for complete combustion of the fine coal powder. The amount of the primary air is 0.2–0.3 times of the air necessary for complete combustion of the fine coal powder, the amount of the secondary air is approximately 0.1 times, and the rest of the air is supplied as the third air.

In accordance with the present embodiment, a flame holding ring 21 is provided at the tip of the fine coal powder nozzle. Due to the flame holding ring 21, a circulating flow 22 flown from the downstream toward upstream is formed in the downstream of the flame holding ring 21, and the fine coal powder is ignited by the gas at a high temperature retained in this portion.

In accordance with the present invention, the tertiary air 16 is injected with an angle in the range from 35 degrees to 55 degrees to the central axis of the fine coal powder nozzle by the guide vane 23. And, feature of the present embodiment is in setting a ratio of the momentum of the tertiary air 16 at the injecting outlet to the momentum of the fine coal powder flow 14 in the axial direction at the fine coal powder injecting outlet in the range from 5 to 7.

In accordance with orienting the injected tertiary air flow 16 toward outer periphery, the air flow can be blown separately from the fine coal powder flow 14, which flows at the central portion of the flame in the vicinity of the fine coal powder burner. After decreasing the velocity, the tertiary air 16 is flown toward the central axis by being attracted with the momentum of the fine coal powder flow 14. Therefore, the tertiary air is mixed with the fine coal powder flow flowing at the center in the downstream far away from the fine coal powder burner.

That means, in accordance with the embodiment of the present invention, the tertiary air 16 flows far away from the center of the flame after being injected from the burner in the front stage portion of the flame as indicated in FIG. 1, and flows toward the center of the flame in the rear stage of the flame (at least three times the throat diameter in the fine coal powder injecting direction from the fine coal powder nozzle outlet). Accordingly, mixing the injected air from the air nozzle with the fine coal powder flown near the center of the flame is restricted in the front stage of the flame (less than three times the throat diameter in the fine coal powder injecting direction from the fine coal powder nozzle outlet).

Therefore, the fine coal powder consumes oxygen contained in the carrier air after igniting, and forms a reducing flame 18 having a low oxygen concentration in the downstream of the igniting region 17. Because of low oxygen concentration in the reducing flame 18, nitrogen content in the fine coal powder is released from the coal as reducing materials such as ammonia and hydrogen cyanide. These reducing materials reduce nitrogen oxide (NOx) generated by combustion of the fine coal powder to nitrogen in a high temperature region such as in the flame.

Therefore, generation of the NOx can be suppressed by forming a reducing flame 18 in the flame.

In accordance with the embodiment of the present invention indicated in FIG. 1, an oxidizing flame 19 having a high oxygen concentration extends in the radial direction at the rear stage of the flame, because the air injected from the air nozzle is mixed with fine coal powder flowing at the center of the flame. Accordingly, the combustion of the fine coal powder is enhanced, and the unburned component at the outlet of the combustion apparatus is decreased.

Approximately 20–30% of the nitrogen component contained in fine coal powder is converted to NOx under a low oxygen concentration atmosphere. The percentage of converting the nitrogen to NOx (NOx converting ratio) is decreased with lowering the oxygen concentration.

However, in accordance with proceeding the combustion to exceed 80–90% of combustion ratio, the NOx converting ratio is increased rapidly even in the low oxygen concentration atmosphere, and more than 90% of the nitrogen component is released as NOx. Therefore, influence of the oxygen concentration to the NOx concentration in the flame, combustion of which is proceeded, is smaller than that in the flame, combustion ratio of which is low, at an initial stage of the combustion.

Accordingly, the unburned component can be decreased without increasing the NOx concentration by mixing the air injected from the air nozzle with the fine coal powder in the rear stage of the flame. Because the distance necessary for complete combustion can be shortened, the volume of the combustion apparatus can be decreased.

In accordance with the embodiment of the present invention, the velocity of the fine coal powder flow 14 injected from the fine coal powder nozzle is set at least 20 m/s. The faster the injecting velocity is, the larger the momentum of the fine coal powder is given at the injection, and scattering the fine coal powder in the vicinity of the fine coal powder burner is decreased. In this case, the amount of the fine coal powder passing through the reducing flame 18 formed at the center of the flame is increased, and the reducing reaction of NOx is proceeded.

The conventional fine coal powder burners indicated in FIG. 2 and FIG. 3 in comparison with the first embodiment of the present invention indicated in FIG. 1 are cases when a ratio of the momentum of the air injected from the air nozzle to the momentum of the fine coal powder flow is smaller than that of the embodiment of the present invention. The conventional fine coal powder burner indicated in FIG. 4 is a case when the ratio of the momentum of the air injected from the air nozzle to the momentum of the fine coal powder flow is larger than that of the embodiment of the present invention.

In accordance with the conventional example indicated in FIG. 2, a strong swirling movement is given to the tertiary air flow. In this case, the tertiary air flows far away from the central portion of the flame in the vicinity of the fine coal powder burner, because of a centrifugal force. Furthermore, due to the strong swirling movement, the tertiary air is not mixed with the central portion even in the rear stage of the flame. Therefore, the flame is separated into two portions, that is, the reducing flame 18 at the central portion and the oxidizing flame 17 at the outer portion. Accordingly, although the NOx concentration at the outlet of the combustion apparatus is the same as the first embodiment of the present invention as indicated in Table 1, the unburned component in the ashes at the outlet of the combustion apparatus is higher than the embodiment indicated in FIG. 1.

TABLE 1

| | FIG. 1 | FIG. 2 | FIG. 3 | FIG. 4 |
|---|---|---|---|---|
| Momentum of tertiary air/ Momentum of primary air | 6.5 | 4.3 | 4.3 | 8.6 |
| NOx concentration at outlet of furnace (ppm: converting to at $O_2$ % = 6 vol. %) | 205 | 205 | 280 | 300 |
| Unburned component in the ashes at outlet of furnace (wt. %) | 2.5 | 7.0 | 4.5 | 5.0 |

The conventional example indicated in FIG. 3 is a case when the swirling movement given to the tertiary air flow is weakened. In this case, the tertiary air 16 is mixed with the fine coal powder flow 14 in the vicinity of the fine coal powder burner, and the reducing region is not formed at the central portion of the flame. Therefore, the NOx concentration at the outlet of the combustion apparatus is increased approximately 80 ppm in comparison with the first embodiment of the present invention indicated in FIG. 1.

The conventional example indicated in FIG. 4 is a case when the ratio of the momentum of the tertiary air and the momentum of the fine coal powder flow is larger than that of the embodiment of the present invention. In this case, the fine coal powder flow 14 is attracted by the tertiary air 16. Therefore, the fine coal powder is mixed with the tertiary air in the vicinity of the fine coal powder burner, and the flame is extended in the radial direction in the vicinity of the fine coal powder burner. In this case, the fine coal powder is burnt under an oxygen excessive condition, and the NOx concentration at the outlet of the combustion apparatus is increased as indicated in Table 1.

Figure 5A:
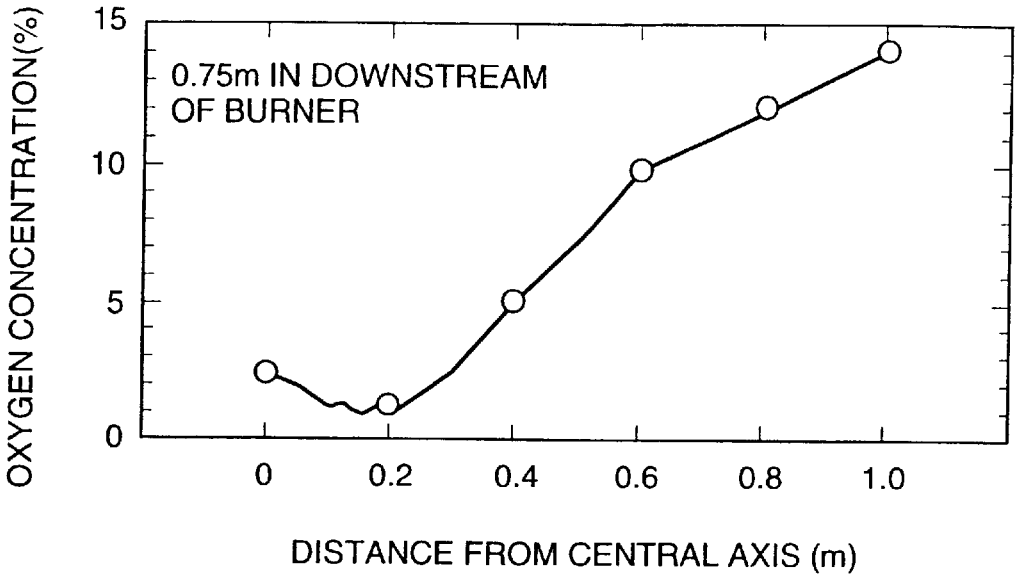
FIG. 5 is a set of graphs indicating oxygen concentration distribution in the flame of the fine coal powder burner relating to the first embodiment of the present invention.
Figure 5B:
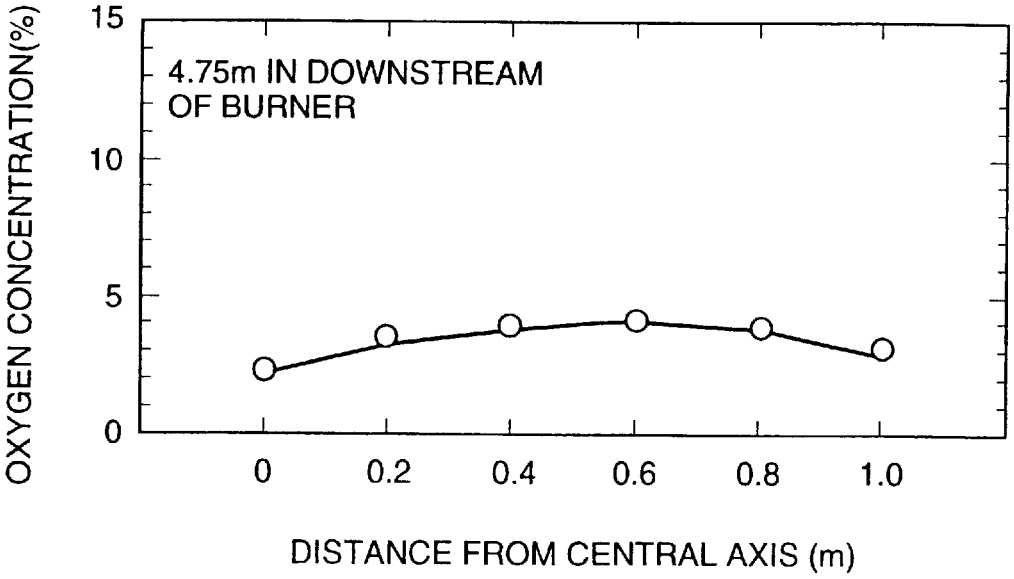
Figure 6A:
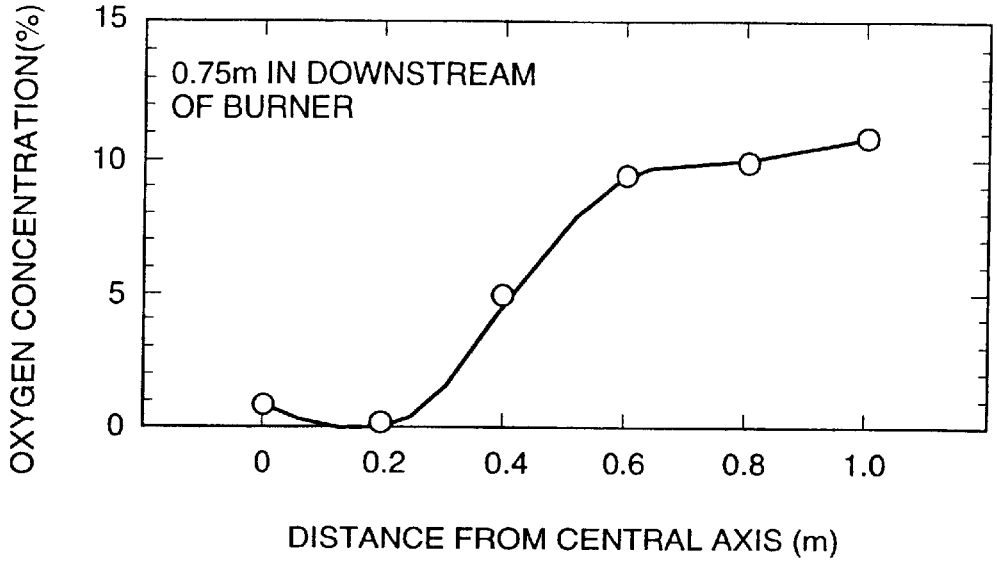
FIG. 6 is a set of graphs indicating oxygen concentration distribution in the flame of the fine coal powder burner relating to the prior art in order to compare with the first embodiment of the present invention.
Figure 6B:
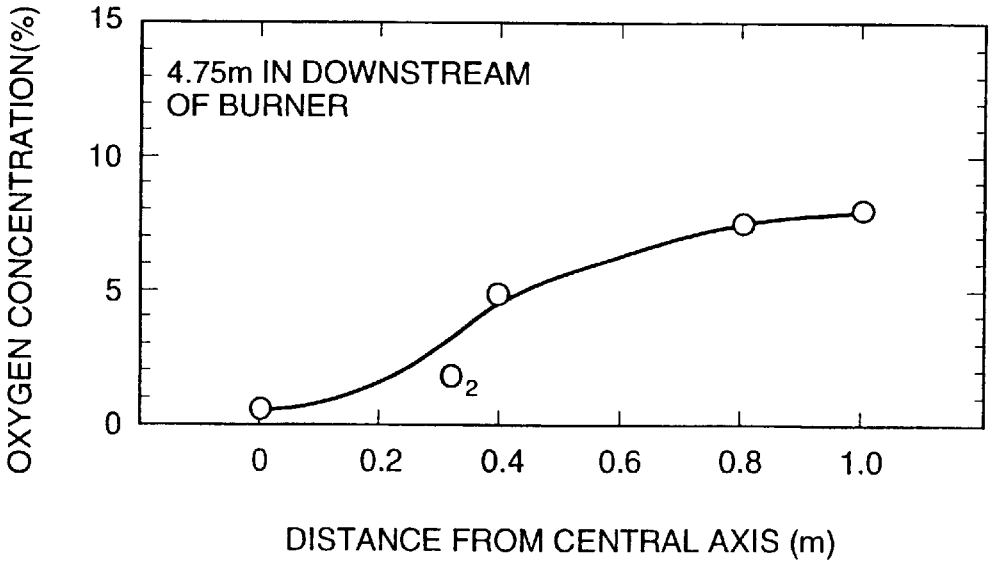

Distributions of oxygen concentration in the furnace at combustion tests of the fine coal powder burners indicated in FIG. 1 and FIG. 2 are indicated in FIG. 5 and FIG. 6, respectively. Both FIG. 5 and FIG. 6 indicate the distribution in the radial direction at two points, the one is in the vicinity of the fine coal powder burner and the other is in the downstream of the burner. In comparison of FIG. 5 with FIG. 6, a region having a low oxygen concentration is formed on the central axis in the vicinity of the fine coal powder burner in both cases, and it is revealed that the region becomes the reducing flame. However, in accordance with the embodiment of the present invention indicated in FIG. 5, the difference of the oxygen concentration in the radial direction at the position of 4.75 m in the downstream from the burner becomes as flat as within approximately 2%. On the contrary, in accordance with the conventional example indicated in FIG. 6, a portion having a low oxygen concentration exists, and the difference of the oxygen concentration in the radial direction between the center and the outer periphery becomes approximately 8%. Therefore, combustion of the fine coal powder passing through the center does not proceed sufficiently, and the unburned component in the ashes is increased in comparison with the present embodiment as indicated in Table 1.

In accordance with the embodiment of the present invention, the oxygen concentration in the radial direction becomes flat in the rear stage portion of the flame. Therefore, the combustion reaction is proceeded rapidly, and improvement of the combustion efficiency and decrease of the unburned component in the ashes are realized. Because the fine coal powder is not scattered in the vicinity of the fine coal powder burner, the amount of the fine coal powder passing through the reducing flame is increased, and the generating amount of NOx is decreased in comparison with the conventional example.

Figure 7:
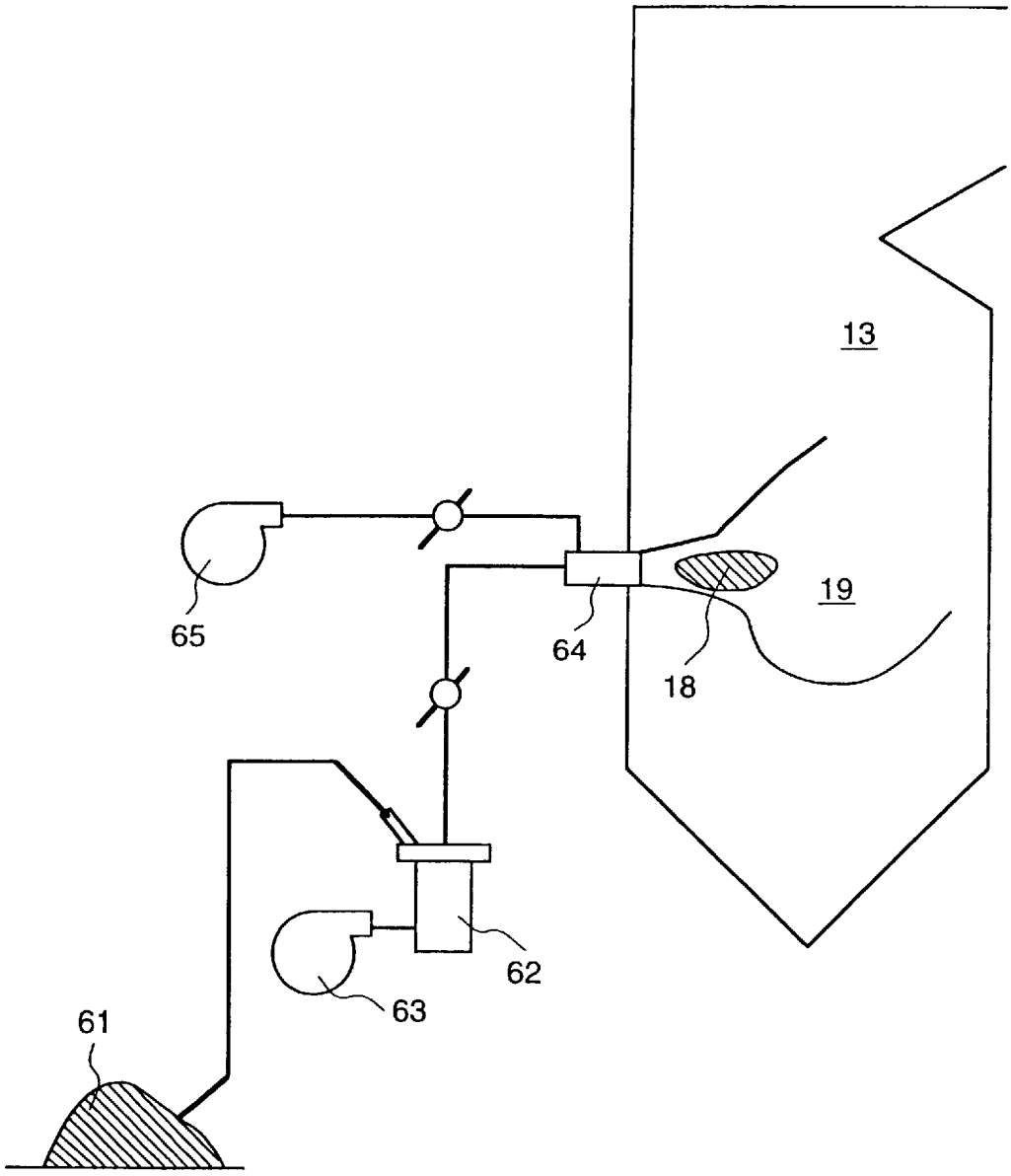
FIG. 7 is a schematic illustration of a combustion apparatus using the finer coal powder burner relating to the first embodiment of the present invention.
Figure 8:
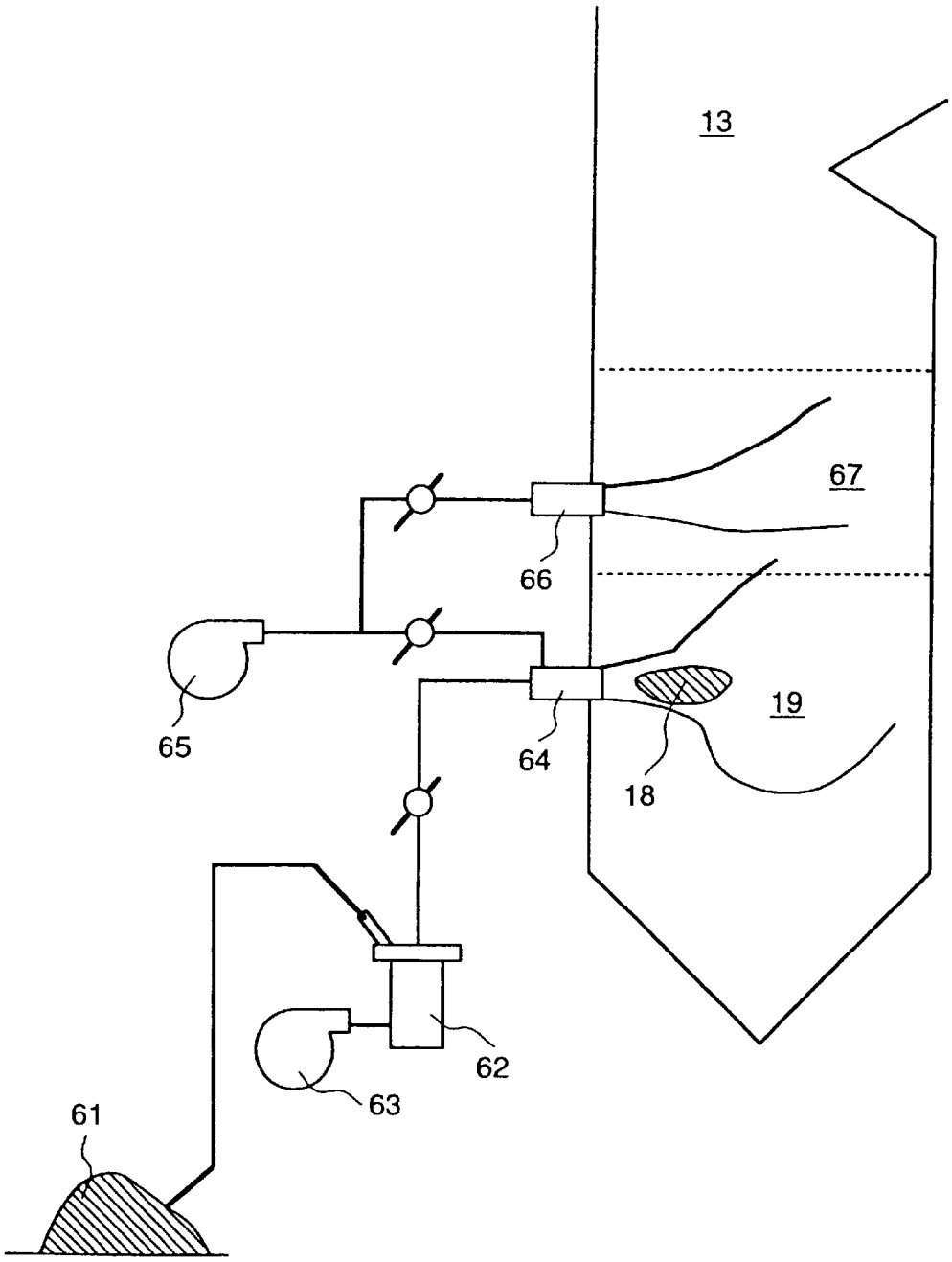
FIG. 8 PRIOR ART
FIG. 8 is a schematic illustration of a combustion apparatus relating to the prior art indicating for comparison with the first embodiment of the present invention indicated in FIG. 7.

FIG. 7 indicates schematically a combustion apparatus using the fine coal powder burner of the first embodiment of the present invention. FIG. 8 is a schematic illustration of a two stage burning type combustion apparatus indicated for comparison with the embodiment of the present invention indicated in FIG. 7. In accordance with FIG. 7 and FIG. 8, the mark 61 indicates a coal storage, and the mark 62 indicates a pulverizer of coal. The coal is pulverized to smaller than 0.1 mm in diameter by the pulverizer of coal 62. The pulverized coal (fine coal powder) is transferred to the fine coal powder burner with air by the blower 63. The air for combustion is supplied by the blower 65.

The two stage burning type combustion apparatus indicated in FIG. 8 is provided with an inlet 66 for injecting a part of the air for burning into the downstream of the fine coal powder burner 64. Therefore, the two stage burning type combustion apparatus requires a space 67 for mixing the air injected from the inlet 66 with the fine coal powder. For instance, in accordance with a boiler furnace (combustion apparatus) for 1000 MW class power generation, ensuring a height of approximately 5 meters is necessary as a mixing space for air of the two stage burning to 60 meters of the furnace height.

However, in a case when the total air for burning is injected into the combustion apparatus from the fine coal powder burner 64 as the embodiment of the present invention, the fine coal powder is mixed with the air for burning at a position approximately three times of the burner throat diameter apart from the nozzle as indicated in FIG. 1. Accordingly, the height of the combustion apparatus can be decreased in comparison with the case of the two stage burning type combustion apparatus. The decrease in height makes it possible to decrease the total weight of the apparatus, and manufacturing cost of the combustion apparatus can be decreased by simplifying the supporting structure.

(Embodiment 2)

Figure 9:
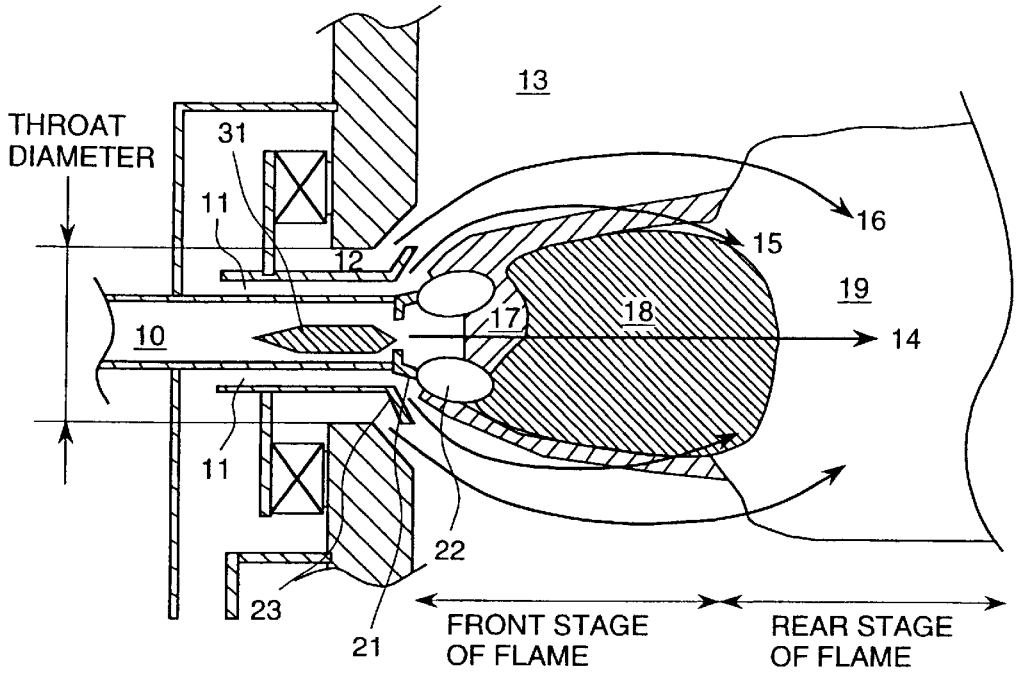
FIG. 9 is a vertical cross sectional view of the fine coal powder burner relating to a second embodiment of the present invention.

FIG. 9 is a schematic illustration of a fine coal powder burner indicating the second embodiment of the present invention. In accordance with FIG. 9, the air nozzle is divided into two nozzles such as a secondary air nozzle and a tertiary air nozzle. A flame holding ring 21 is provided at the tip of the fine coal powder nozzle. The present embodiment indicated in FIG. 9 differs from the embodiment indicated in FIG. 1 in comprising a spindle body 31 in the fine coal powder nozzle.

In accordance with the presence of the spindle body 31 in the fine coal powder nozzle, the velocity of the fine coal powder flow passing outer periphery of the spindle body is increased. After passing the spindle body portion in the nozzle, the velocity of the air is decreased by enlarging the flow cross section. However, the fine coal particle is injected with a faster flow velocity than air, because the fine coal particle has a heavier mass than the air. Accordingly, diffusion of the fine coal powder in the radial direction is delayed than the carrier air after injecting from the fine coal powder nozzle, and consequently, the concentration of the fine coal powder is increased. In this case, the fine coal powder is burnt under an air-deficient condition in the vicinity of the fine coal powder burner, and the range of the reducing flame, which is formed after consumption of oxygen, is extended. Because the amount of the fine coal powder passing through the reducing flame is increased, the reducing reaction of NOx is enhanced, and the NOx generated from the flame is decreased.

(Embodiment 3)

Figure 10:
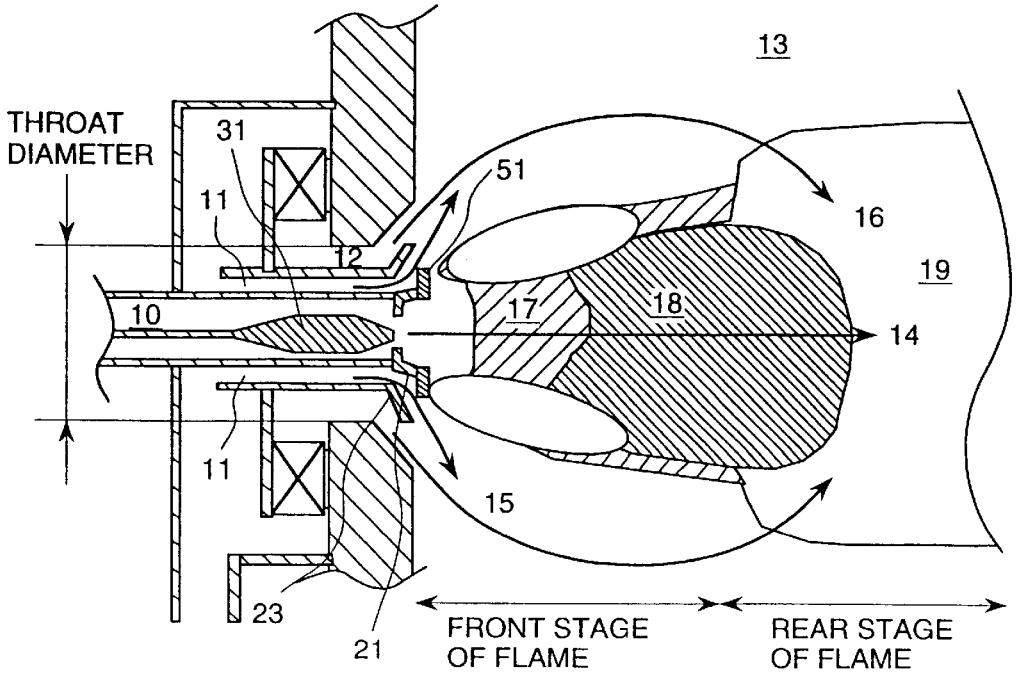
FIG. 10 is a vertical cross sectional view of the fine coal powder burner relating to a third embodiment of the present invention.

FIG. 10 is a schematic illustration of a fine coal powder burner indicating the third embodiment of the present invention. In accordance with FIG. 10, the mark 10 indicates a fine coal powder nozzle for air flow transportation of the fine coal powder, and the nozzle is connected to a transportation pipe (not shown in the figure) in the upstream of the nozzle. Two air nozzles for injecting air for combustion are provided concentrically. Respective of the marks 11, 12 indicates a secondary air nozzle and a tertiary air nozzle. The mark 13 indicates a furnace space for burning the fine coal powder and air injected from the burner. The mark 14 indicates a flow of the fine coal powder injected from the fine coal powder nozzle, and the marks 15, 16 indicate the air injected from the secondary and tertiary air nozzles, respectively.

In accordance with the present embodiment, inner periphery of the outlet of the tertiary air nozzle 12 has a tapered sleeve, and the tertiary air is injected in a direction apart from the fine coal powder flow with an angle in the range of 35–55 degrees to the injecting direction (axial direction) of the fine coal powder flow. In this case, the tip of the guide vane 23 is positioned on an extending line of the outer peripheral side wall plane of the throat portion flow path for the tertiary air, all the tertiary air passing through the throat portion are changed in its injecting direction. A flame holding ring 21 is provided at the tip of the fine coal powder nozzle, and the injecting velocity of the secondary air is accelerated, because the flow path of the secondary air becomes narrow by the presence of the flame holding ring 21.

Furthermore, a guide vane 51 is provided perpendicularly to the fine coal powder injecting direction at the secondary air flow path side of the tip of the flame holding ring. Due to the guide vane 51, the secondary air is injected in the outer peripheral direction (in the range of 70–85 degrees to the injecting direction of the fine coal powder). The mark 13 indicates a furnace space for burning the fine coal powder and air injected from the burner, and the mark 14 indicates the flow of the fine coal powder injected from the fine coal powder nozzle.

In accordance with the present embodiment, a single stage combustion, wherein all the air necessary for complete burning of the fine coal powder is supplied from the fine coal powder burner, is used. In this case, the amount of air actually supplied from the fine coal powder burner is approximately 1.1–1.25 times of the theoretically necessary amount of the air for complete combustion of the fine coal powder. The amount of the primary air is 0.2–0.3 times of the air necessary for complete combustion of the fine coal powder, the amount of the secondary air is approximately 0.1 times, and the rest of the air is supplied as the third air.

In accordance with the present embodiment, a flame holding ring 21 is provided at the tip of the fine coal powder nozzle. Due to the flame holding ring 21, a circulating flow 22 flown from the downstream toward upstream is formed in the downstream of the flame holding ring 21, and the fine coal powder is ignited by the gas at a high temperature retained in this portion. The present embodiment of the invention is characterized in that the momentum of the tertiary air flow 16 at the injection outlet is set at a value in the range of 5–7 in the ratio to the momentum in the axial direction of the fine coal powder flow 14 at the injecting outlet of the fine coal powder nozzle.

The circulating flow in the downstream of the flame holding ring 21 is enhanced by providing the guide vane 51, because the secondary air 15 is injected in the outer peripheral direction. Then, because the combustion gas at a high temperature is flown into the circulating flow from the downstream, the temperature of the circulating flow is increased, and ignition of the fine coal powder is enhanced. The momentum of the tertiary air 16 in the outer peripheral direction is increased, because the tertiary air is mixed with the secondary air 15. Therefore, it becomes possible to flow the tertiary air separating from the fine coal powder flow 14, which flows at the central portion, in the vicinity of the fine coal powder burner.

After decreasing the velocity of the tertiary air 16, the tertiary air flows toward the central axis by being attracted with the momentum of the fine coal powder flow 14. Therefore, the tertiary air 16 is mixed with the fine coal powder flow, which flows at the central portion, in the downstream apart from the fine coal powder burner.

In accordance with the present embodiment, the tertiary air 16 flows apart from the central axis in the front stage of the flame after injected from the burner as indicated in FIG. 10, and flows toward the central portion of the flame in the rear stage of the flame (at least three times the burner throat diameter from the fine coal powder nozzle outlet in the fine coal powder injecting direction). Therefore, mixing the air injected from the air nozzle with the fine coal powder, which flows at the central portion of the flame, is suppressed in the front stage of the flame (within three times of the burner throat diameter from the fine coal powder nozzle outlet in the fine coal powder injecting direction).

Accordingly, oxygen contained in the carrier air is consumed by the fine coal powder with ignition, and the reducing flame 18 having a low oxygen concentration is formed in the downstream of the ignition region 17. Because the oxygen concentration in the reducing flame 18 is low, the nitrogen component contained in the fine coal powder is released as a reducing materials such as ammonia, and hydrogen cyanide, and nitrogen oxide (NOx) is reduced to nitrogen. Therefore, generation of the NOx can be suppressed by forming the reducing flame 18 in the flame.

In accordance with the present embodiment of the invention indicated in FIG. 10, the air injected from the air nozzles is mixed with the fine coal powder flown in the central portion of the flame in the rear stage of the flame, and an oxidizing flame 19 having a high oxygen concentration is extended in the radial direction. Therefore, the combustion of the fine coal powder is enhanced, and the unburned component in the ashes at the outlet of the combustion apparatus can be decreased.

(Embodiment 4)

Figure 11:
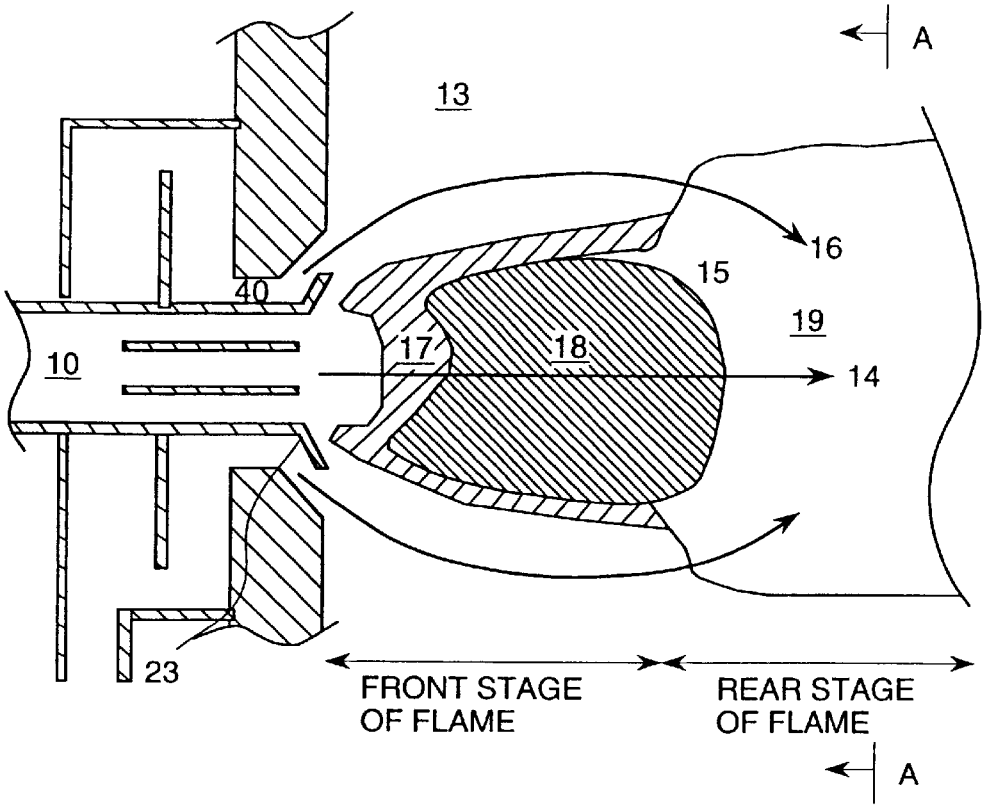
FIG. 11 is a vertical cross sectional view of the fine coal powder burner relating to a fourth embodiment of the present invention.
Figure 12:
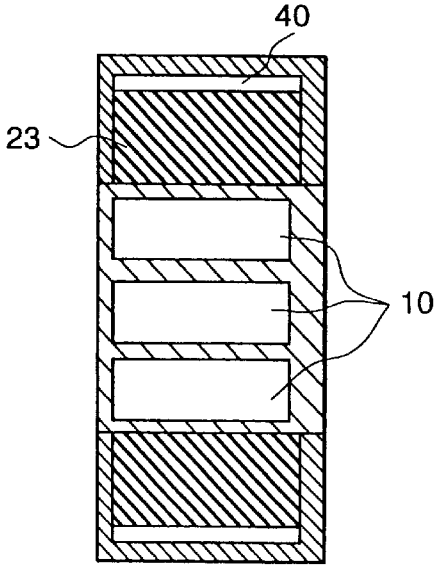
FIG. 12 is a front elevation of the fine coal powder burner relating to the fourth embodiment of the present invention.

FIG. 11 is a schematic illustration of a fine coal powder burner indicating the fourth embodiment of the present invention. FIG. 12 indicates a cross section taken along the line A—A in FIG. 11. In accordance with FIG. 11, the mark 10 indicates a fine coal powder nozzle for air flow transportation of the fine coal powder, upstream side of which is connected to a transportation pipe (not shown in the figure). The mark 40 indicates air nozzles provided interposing the fine coal powder nozzle. The air nozzle 40 and the fine coal powder nozzle 10 can be divided into plural portions as indicated in the present embodiment. The air nozzles 40 and the fine coal powder nozzles 10 are not necessarily provided concentrically. The mark 13 indicates a furnace space for burning the fine coal powder and the air injected from the burner. The mark 14 indicates a flow of the fine coal powder injected from the fine coal powder nozzle, and the mark 41 indicates a flow of the air for combustion injected from the air nozzle.

The present embodiment uses a single stage combustion, wherein all the air necessary for complete burning of the fine coal powder is supplied from the fine coal powder burner. Generally, the amount of air actually supplied from the fine coal powder burner is approximately 1.2 times of the necessary amount of the air for complete combustion of the fine coal powder. The amount of the air supplied from the fine coal powder nozzle 10 is 0.2–0.3 times of the air necessary for complete combustion of the fine coal powder, and the rest of the air is supplied from the air nozzle 40.

In accordance with the present embodiment, the air combustion 41 flows apart from the central axis in the front stage of the flame after injection from the burner, and flows toward the central portion of the flame in the rear stage of the flame (at least three times of the burner throat diameter from the fine coal powder nozzle outlet in the fine coal powder injecting direction). Therefore, mixing the air injected from the air nozzle with the fine coal powder, which flows at the central portion of the flame, is suppressed in the front stage of the flame. Accordingly, the reducing flame 18 having a low oxygen concentration is formed in the downstream of the ignition region 17.

The ignition region 17 surrounding the reducing flame 18 is an oxidizing flame 17 having a high oxygen concentration, because the oxygen is not consumed. The air injected from the air nozzles is mixed with the fine coal powder flown in the central portion of the flame in the rear stage of the flame, and an oxidizing flame 19 having a high oxygen concentration is extended in the radial direction.

In accordance with the present embodiment of the invention, the air for combustion is injected with an angle in the range of 35–55 degrees to the central axis of the fine coal powder nozzle 10. One of the feature of the present embodiment is to set a ratio of momentum of the air flow at the outlet of the air nozzle to momentum of fine coal powder flow at the outlet of the fine coal powder nozzle in the axial direction as a value in the range of 5–7.

In accordance with injecting the air flow from the air nozzles in a direction toward an outer peripheral direction, the air can be flown separately from the fine coal powder flow, which flows at the center of the flame in the vicinity of the fine coal powder burner. Because the air flows as a circulating flow in the space between the fine coal powder flow and the air flow, the air flows toward the central axis along the circulating flow, after decreasing the injecting velocity. Therefore, the air is mixed with the fine coal powder, which flows at the central portion of the flame, in the downstream apart from the fine coal powder burner.

Therefore, in accordance with the present embodiment of the invention, the oxygen concentration distribution in the radial direction becomes flat in the rear stage of the flame. The combustion reaction is proceeded, and the improvement of the combustion efficiency and decrease of the unburned component in the ashes are realized. Because the fine coal powder is not scattered in the vicinity of the fine coal powder burner, the amount of the fine coal powder passing through the reducing flame is increased, and the amount of NOx is decreased in comparison with the conventional example.

In accordance with the method for burning the fine coal powder of the present invention as explained hitherto, the air flow from the air nozzles are injected in a direction toward an outer peripheral direction to the central axis of the fine coal powder nozzles; the air flows separately far from the center of the flame in the front stage of the flame; the air flows toward the center of the flame in the rear stage of the flame (a distance at least three times of the burner throat diameter from the outlet of the burner nozzle). A reducing flame 18 having a low oxygen concentration is formed in the central portion of the fine coal powder combustion flame by consuming the oxygen by a combustion reaction in the downstream of the combustion region 17. Furthermore, in the rear stage of the flame, the air injected from the air nozzles is mixed with the fine coal powder flown in the central portion of the flame, and an oxidizing flame 19 is extended in the radial direction. Because most of the fine coal powder passes through the reducing flame 18, the exhausted NOx concentration is decreased. The distribution of the air becomes uniform, and any region, the gaseous phase of which is extremely low air ratio, is not formed. Accordingly, the combustion reaction is proceeded, the combustion efficiency is improved, and decrease of the unburned component in the ashes is realized.

In accordance with the present invention, the fine coal powder combustion apparatus, the method for burning the fine coal powder, and the fine coal powder burner, wherein the amounts of the generating NOx and the unburned component in the ashes of the fine coal powder are small, can be provided without increasing the furnace height.

What is claimed is:

1. A fine coal powder combustion method for a fine coal powder combustion burner, comprising the steps of:

injecting a mixture of the fine coal powder and air with a fine coal powder nozzle, and injecting air with at least one air nozzle arranged peripherally outside of said fine coal powder nozzle;

supplying air in an amount in excess required for complete combustion of the fine coal powder from said air nozzles;

forming a reducing flame at a high temperature (a flame, wherein a ratio of an actual amount of air to a necessary amount of air for burning completely the components released from the fine coal powder as gases is smaller than 1) by igniting the fine coal powder rapidly in the vicinity of the outlet of the burner and consuming oxygen rapidly;

forming an oxidizing flame (a flame, wherein a ratio of an actual amount of air to a necessary amount of air for burning completely the components released from the fine coal powder as gases is larger than 1) having a uniform distribution of gas composition in a radial direction to a central axis of the burner by mixing the air injected from the air nozzle downstream of the reducing flame at the high temperature; and changing the flow of the air injected from an air nozzle positioned at an outermost periphery of the burner with an angle in the range of 35–55 degrees to the fine coal powder injecting direction (axial direction);

supplying a sufficient amount of air for complete combustion of the fine coal powder from the at least one air nozzle and making an injecting velocity of the fine coal powder flow injected from the fine coal powder nozzle be at least 20 m/s, wherein a ratio of momentum of fine coal powder flow at the outlet of the fine coal powder nozzle in the injecting direction (axial direction) to momentum of the air flow at the outlet of the air nozzle is set to be 1:5–7.

2. A fine coal powder combustion method for a fine coal powder combustion burner as claimed in claim 1, wherein:

the air nozzle positioned at an outermost periphery of the burner has a guide vane; and said changing of the flow of the air injected from the air nozzle positioned at an outermost periphery of the burner is performed with said guide vane and a tip of said guide vane extends to a line extending from an outer peripheral wall of a throat portion of said air nozzle positioned at an outermost periphery of the burner.

3. A fine coal powder combustion method for a fine coal powder combustion burner comprising:

injecting a mixture of fine coal powder and primary air with a fine coal powder nozzle;

injecting secondary air with a secondary air nozzle which is arranged at an outer periphery of said fine coal powder nozzle concentrically with said fine coal powder nozzle;

injecting tertiary air with a tertiary air nozzle, which is arranged at an outer periphery of said secondary air nozzle concentrically with said secondary air nozzle; and changing the flow of the air injected from the secondary air nozzle with a reversely tapered portion of said secondary air nozzle that is arranged at a tip of an outer peripheral wall of said secondary air nozzle;

wherein the air injected from said secondary air nozzle flows at an outer peripheral side along the reversely tapered portion of said secondary air nozzle, and wherein a ratio of momentum of fine coal powder flow at the outlet of the fine coal powder nozzle in the injecting direction (axial direction) to momentum of the air flow at the outlet of the tertiary air nozzle is set to be 1:5–7 by supplying a sufficient amount of air for complete combustion of said fine coal powder from the burner.

4. A fine coal powder combustion method for a fine coal powder combustion burner as claimed in claim 3, further including:

changing the flow of the air injected from the secondary air nozzle with a guide vane arranged at a tip of an inner peripheral wall of the secondary air nozzle that has a more acute angle than the reversely tapered portion provided at the tip of the outer peripheral wall of said secondary air nozzles.

5. A fine coal powder combustion method for a fine coal powder combustion burner as claimed in claim 3, further including:

changing a flow of the air injected from the tertiary air nozzle positioned at an outermost periphery of the burner with an angle in the range of 35–55 degrees to the fine coal powder injecting direction (axial direction) with a wall portion extending from an inner peripheral wall of said tertiary air nozzle to an outer peripheral direction; and a tip of said wall portion being positioned on a line extending from an outer peripheral side wall plane of a throat portion that forms said tertiary air nozzle.

6. A fine coal powder combustion method for a fine coal powder combustion burner as claimed in claim 5, further including:

changing the flow of the air injected from the secondary air nozzle with a guide vane arranged at a tip of an inner peripheral wall of the secondary air nozzle that has a more acute angle than the reversely tapered portion provided at the tip of the outer peripheral wall of said secondary air nozzles.

7. A fine coal powder combustion method for a fine coal powder combustion burner as claimed in claim 6, wherein:

said flow of the air injected from the secondary air nozzle is changed to an angle in the range of 70–85 degrees to the fine coal powder injecting direction (axial direction) with aid of said guide vane; and a tip of said guide vane is positioned on a line extending from an outer peripheral side wall plane of a throat portion that forms said secondary air nozzle.

* * * * *